US009038230B2

(12) United States Patent
O'Neill

(10) Patent No.: US 9,038,230 B2
(45) Date of Patent: May 26, 2015

(54) CLEANING DEVICE

(71) Applicant: Luke O'Neill, Holland Park (AU)

(72) Inventor: Luke O'Neill, Holland Park (AU)

( * ) Notice: Subject to any disclaimer, the term of this patent is extended or adjusted under 35 U.S.C. 154(b) by 0 days.

(21) Appl. No.: 14/358,920

(22) PCT Filed: Sep. 25, 2012

(86) PCT No.: PCT/AU2012/001155

§ 371 (c)(1),
(2) Date: May 16, 2014

(87) PCT Pub. No.: WO2013/071334

PCT Pub. Date: May 23, 2013

(65) Prior Publication Data

US 2014/0304928 A1 Oct. 16, 2014

(30) Foreign Application Priority Data

Nov. 17, 2011 (AU) ..... 2011253740

(51) Int. Cl.
*A45D 27/46* (2006.01)
*A46B 11/06* (2006.01)
*A46B 13/00* (2006.01)

(52) U.S. Cl.
CPC ..... *A45D 27/46* (2013.01); *A46B 11/06* (2013.01); *A46B 13/005* (2013.01)

(58) Field of Classification Search
CPC ..... A45D 27/46; A46B 11/06
USPC ..... 15/21.1, 24, 25, 104.92, 160, 205.2; 4/654, 678; 30/41
See application file for complete search history.

(56) References Cited

U.S. PATENT DOCUMENTS

| | | | | |
|---|---|---|---|---|
| 4,838,949 | A | 6/1989 | Dugrot | |
| 4,928,675 | A | 5/1990 | Thornton | |
| D380,067 | S * | 6/1997 | Brenneman | D32/1 |
| 6,598,256 | B2 * | 7/2003 | Theriault | 15/104.92 |

FOREIGN PATENT DOCUMENTS

DE 3125940 A1 1/1983

OTHER PUBLICATIONS

International Search Report for PCT/AU2012/001155, ISA/AU, Woden ACT, mailed Oct. 22, 2012.

* cited by examiner

*Primary Examiner* — Randall Chin
(74) *Attorney, Agent, or Firm* — Harness, Dickey & Pierce, PLC

(57) ABSTRACT

A cleaning device for a safety razor having single or multiple parallel blades is disclosed. A hollow connector is affixed to a water tap of a bathroom sink allowing water to flow therethrough into a body depending from the connector, rotating a brush held in the body and exiting through a slot in the body. The shaving head of the razor is positioned with the slot such that the blades within the head are embedded within the bristles of the brush. As the brush rotates, its bristles remove shaving debris from between the blades and immediate surrounds. After use, the device can easily be disassembled to facilitate cleaning of all components thereof.

10 Claims, 2 Drawing Sheets

CLEANING DEVICE

CROSS-REFERENCE TO RELATED APPLICATIONS

This application is a 371 U.S. National Stage of International Application No. PCT/AU2012/001155, filed Sep. 25, 2012. This application claims the benefit of Australian Patent Application No. 2011253740, filed Nov. 17, 2011. The disclosures of the above applications are incorporated herein by reference.

TECHNICAL FIELD

This invention relates to a cleaning device. In particular, this invention is directed to a cleaning device for a safety razor.

BACKGROUND ART

It is to be clearly understood that mere reference herein to previous or existing apparatus, products, systems, methods, practices, publications or other information, or to any associated problems or issues, does not constitute an acknowledgement or admission that any of those things individually or in any combination formed part of the common general knowledge of those skilled in the field or are admissible prior art.

Parallel blade shaving razors, having single or multiple (up to five (5) or more) blades, are in common use today by both men and women. One problem with such razors, however, is that they are difficult to clean principally because of (1) the small spaces between and around the parallel blades with their staggered edges and (2) the parallel blades are encased within the shaving head and are not removable from the head. With such a construction, shaving debris is easily trapped and can be difficult to dislodge by the traditional methods of holding under running water or by the user shaking the razor in a body of water.

Although there have been a number of attempts in the prior art to overcome this difficulty in cleaning of safety razors, the resultant devices are complicated or bulky in their structure or unacceptably expensive to manufacture and thus purchase.

There thus remains a need for an inexpensive to manufacture and purchase, simple to operate device to clean a safety razor having one or more blades.

SUMMARY OF THE INVENTION

According to at least one broad form of the present invention, there is provided a device to clean a shaving razor of the type having at least one blade encased in a head, said device including:

a hollow body having a first end adapted to be affixed to a water faucet and a second end terminating in a hollow chamber, said body and said chamber being adapted to allow water to flow through said body from said first end to exit from said chamber;

a brush or similar affixed within said chamber, said brush adapted to rotate as said water flows through said body to exit from said chamber; and a slot in said chamber through which said at least one blade can be passed and placed in contact with said brush as said brush is being rotated.

In some embodiments of the present invention, said first end may include a quick release coupling to said faucet.

In those embodiments of the present invention which includes a said quick release coupling, said coupling may be a resilient push-fit connection.

In other embodiments of the present invention, said first end may be internally and/or externally threaded to affix to said faucet.

In yet other embodiments of the present invention, said body (or one or more parts of said body) may be manufactured from a resilient material having an internally and/or externally threaded said first end. In these embodiments, a single said device may be either affixed to a threaded said faucet or to a non-threaded faucet as a push-fit connector.

Said brush may substantially elongated and cylindrical in shape.

Alternatively, said brush may have bristles arranged in one or more rows or lines. Said row(s) or line(s) of bristles may be straight or curved, and may be arranged such that bristles contact with said blade across most or all of said blade when said blade is placed in contact with said rotating brush. In some embodiments, the brush may include multiple rows of bristles where each row extends substantially the width of the brush.

Optionally, respective components of said device are releasably connected to facilitate access to said brush for the cleaning of shaving debris from said brush after said device has been used.

Preferably, said body is manufactured from a plastic material.

BRIEF DESCRIPTION OF THE DRAWINGS

Preferred features, embodiments and variations of the invention may be discerned from the following Detailed Description which provides sufficient information, for those skilled in the art to perform the invention. The Detailed Description is not to be regarded as limiting the scope of the preceding Summary of the Invention in any way. The Detailed Description will make reference to a number of drawings as follows.

DETAILED DESCRIPTION

Figure 1:
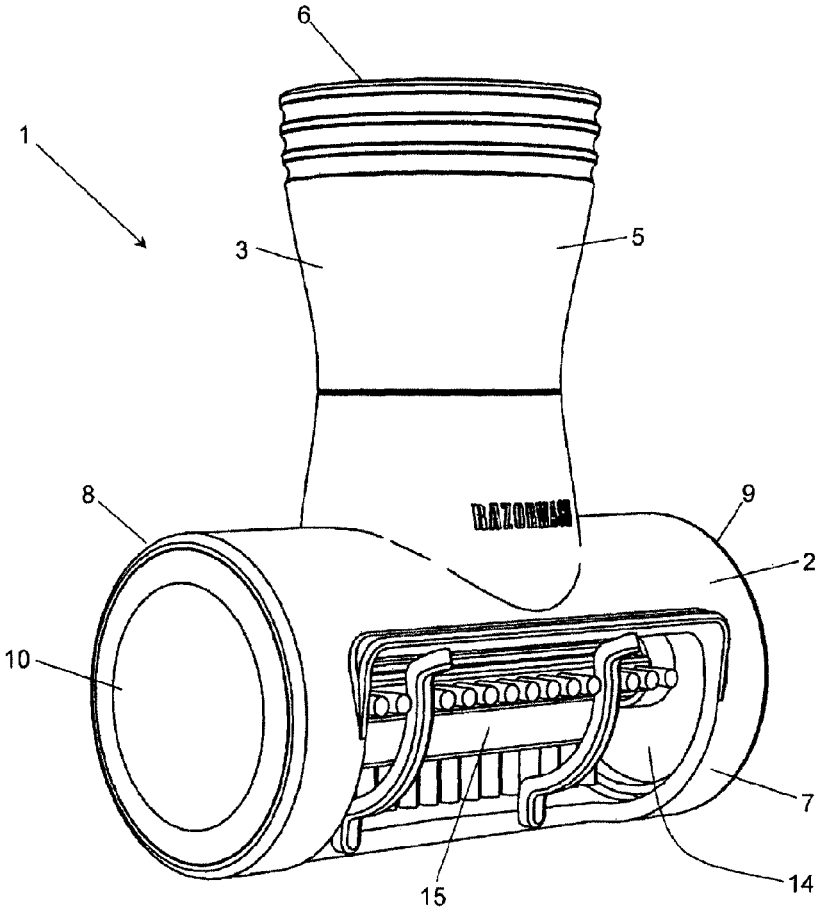
FIG. 1 is a perspective illustration of an assembled device in accordance with an embodiment of the present invention.
Figure 2:
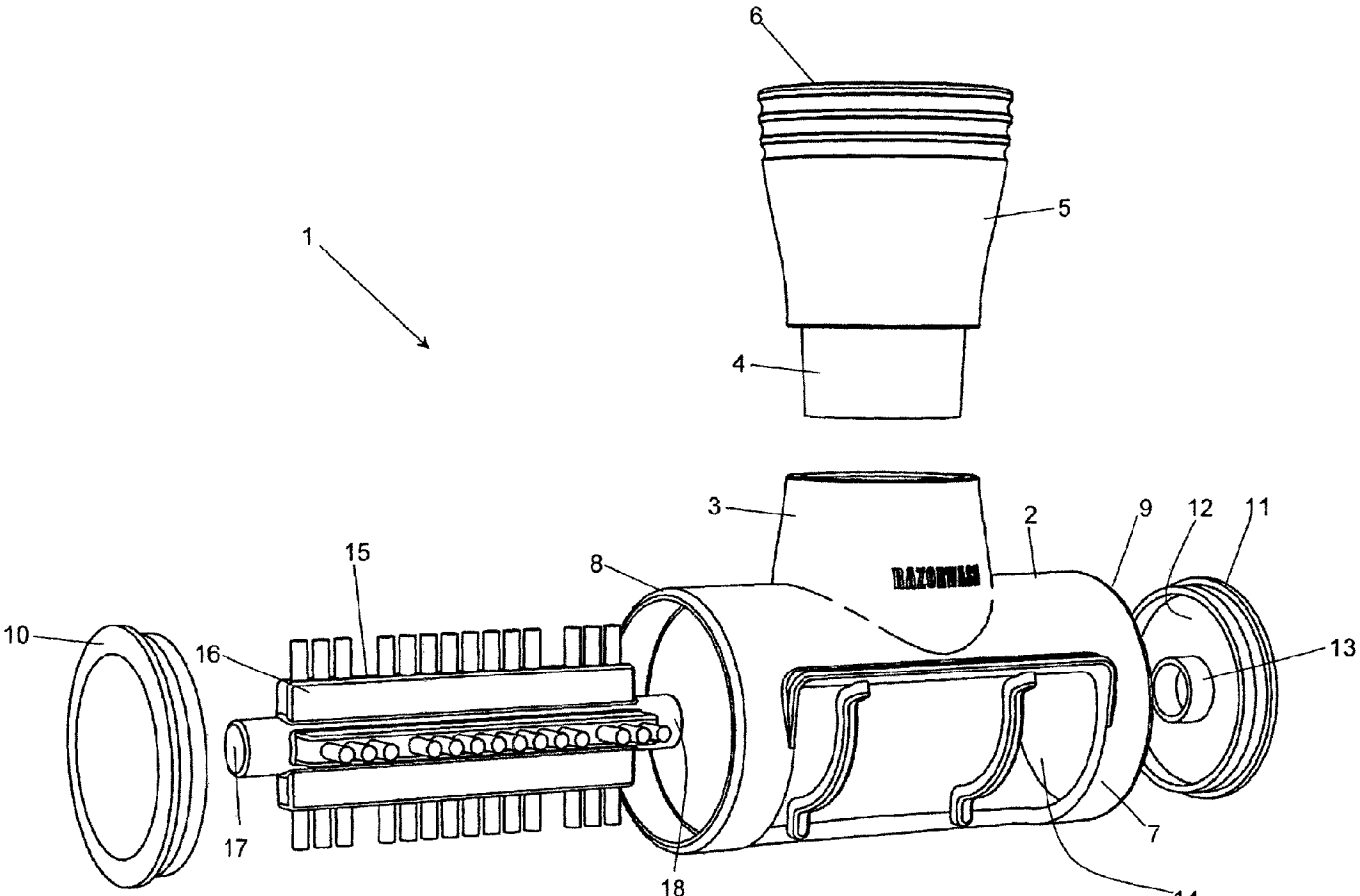
FIG. 2 is a perspective exploded illustration of the device of FIG. 1.

Referring to the FIGS., the device (1) comprises a hollow substantially T-shaped body (2) conveniently manufactured from any suitable plastic material known in the art. The hollow substantially orthogonal leg portion (3) of the body (2) is of a dimension to allow the stem (4) of a hollow connector (5) to be retained therein as an interference fit. The connector (5) including its stem (4) is conveniently manufactured from any suitable resilient rubber or plastics material known in the art. The internal diameter of the connector (5) at its upper end (6) is sufficient for a releasable push-fit connection to a water faucet. Optionally, an internal and/or external region of the connector (5) at or near its upper end (6) may be threaded to allow a threaded connection to a complementary threaded water faucet or similar. The head portion (7) of the body (2) has its opposing ends (8,9) closed by corresponding caps (10,11) each being an interference fit. The interior surface (12) of the end cap (11) includes a short hollow extension (13). The interior surface of the end cap (10) includes a similar short hollow extension (not illustrated). The head portion (7) of the body (2) has a slot (14) running substantially the full longitudinal length thereof. A rotatable brush (15) includes a spindle (16) the respective opposing longitudinal ends of which terminate in short spigots (17,18) which are a rotatable fit in the respective short hollow extensions of the caps (10,11). All components of the brush (15) can be conveniently manufactured from any suitable combination of plastic materials known in the art.

In use, to clean the blades of a parallel blade razor (not illustrated), the end (6) of the connector (5) is affixed to a water faucet such as a tap of a bathroom sink (not illustrated). The end (6) either screws onto a threaded faucet or is a push-fit connection thereto. The tap is then turned on and water flows through the connector (5) and the body (2), rotates the brush (15) and exits through the slot (14). The shaving head of the razor is positioned within the slot (14) such that, as the brush (15) rotates, its bristles contact with the blades remove shaving debris from between the blades and immediate surrounds. After use, the device (1) can easily be disassembled to facilitate cleaning of all components thereof prior to the next use of the device (1).

The present invention can thus provide an inexpensive, simple to operate and maintain cleaning device for the parallel blade(s) of a safety razor.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A device to clean a shaving razor of the type having at least one blade encased in a head, said device including:

a hollow body having a first end adapted to be affixed to a water faucet and a second end terminating in a hollow chamber, said body and said chamber being adapted to allow water to flow through said body from said first end to exit from said chamber;

a brush or similar affixed within said chamber, said brush adapted to rotate as said water flows through said body to exit from said chamber; and a slot in said chamber through which said at least one blade can be passed and placed in contact with said brush as said brush is being rotated.

2. The device as defined in claim 1 wherein said first end includes a quick release coupling to said faucet.

3. The device as defined in claim 2 wherein said coupling is a resilient push fit connection.

4. The device as defined in claim 1 wherein said first end is threaded to affix to said faucet.

5. The device as defined in claim 4 wherein said body is manufactured from a resilient material.

6. The device as defined in claim 1 wherein said brush is substantially elongated and cylindrical in shape.

7. The device as defined in claim 1 wherein said brush has bristles arranged in one or more rows.

8. The device as defined in claim 7 wherein the brush includes multiple rows of bristles where each row extends substantially the width of the brush.

9. The device as defined in claim 1 wherein said body and said chamber are releasably connected to the water faucet to facilitate access to said brush for the cleaning of shaving debris from said brush after said device has been used.

10. A device as defined in 1 wherein said body is manufactured from a plastic material.

* * * * *